US006244173B1

(12) United States Patent
Tomikawa et al.

(10) Patent No.: US 6,244,173 B1
(45) Date of Patent: Jun. 12, 2001

(54) SCREEN-FORMED PLATED ARTICLE COMPRISING MESH CLOTH USING CORE-SHEATH COMPOSITE FILAMENT, AND CYLINDER FOR ROTARY SCREEN

(75) Inventors: Toshihide Tomikawa, Osaka; Shoichiro Noguchi, Kyoto; Toyohiro Tanaka, Osaka, all of (JP)

(73) Assignee: Kanebo Ltd., Tokyo (JP)

( * ) Notice: Subject to any disclaimer, the term of this patent is extended or adjusted under 35 U.S.C. 154(b) by 0 days.

(21) Appl. No.: 09/155,071

(22) PCT Filed: Mar. 17, 1997

(86) PCT No.: PCT/JP97/00860

§ 371 Date: Dec. 31, 1998

§ 102(e) Date: Dec. 31, 1998

(87) PCT Pub. No.: WO97/36038

PCT Pub. Date: Oct. 2, 1997

(30) Foreign Application Priority Data

Mar. 22, 1996 (JP) ..... 8-093181

(51) Int. Cl.[7] ..... B41N 1/24; D03D 15/00; D04H 3/08

(52) U.S. Cl. ..... 101/127; 428/373; 428/379; 442/60; 442/229; 442/364; 442/377

(58) Field of Search ..... 101/116, 127, 101/128.2, 128.4; 128/373, 375, 379, 381; 442/60, 110, 229–231, 364, 377, 200, 228, 232, 376, 378, 379, 380

(56) References Cited

U.S. PATENT DOCUMENTS

| | | | | |
|---|---|---|---|---|
| 653,887 | * | 7/1900 | Robertson | 442/231 |
| 3,958,066 | * | 5/1976 | Imamura et al. | 428/373 |
| 4,388,370 | * | 6/1983 | Ellis et al. | 428/373 |
| 4,500,593 | * | 2/1985 | Weber | 428/373 |
| 4,657,807 | * | 4/1987 | Fuerstman | 422/230 |
| 4,959,260 | * | 9/1990 | Tomoyasu et al. | 428/373 |
| 4,996,099 | * | 2/1991 | Cooke et al. | 428/373 |
| 5,498,464 | * | 3/1996 | Ikejima et al. | 101/128.21 |
| 5,501,146 | * | 3/1996 | Yamanaka et al. | 101/127 |
| 5,622,109 | * | 4/1997 | Ikejima et al. | 101/128.21 |
| 5,740,734 | * | 4/1998 | Mori et al. | 101/127 |
| 5,776,608 | * | 7/1998 | Asher et al. | 428/373 |
| 5,840,383 | * | 11/1998 | Kotz et al. | 442/364 |

FOREIGN PATENT DOCUMENTS

| | | | | |
|---|---|---|---|---|
| 439960 | * | 8/1991 | (EP) | 101/127 |
| 5186966 | | 7/1993 | (JP) . | |
| 222606 | * | 8/1993 | (JP) | 428/379 |
| 7166467 | | 6/1995 | (JP) . | |

OTHER PUBLICATIONS

Metalite, "Metalized Polyester for Screen Printing" Advance Process Supply Co., pp. 1–7. Class 101 Sub 127, May 1976.*

* cited by examiner

*Primary Examiner*—Stephen R. Funk
(74) *Attorney, Agent, or Firm*—Hogan & Hartson, LLP

(57) ABSTRACT

A mesh cloth, which does not bring about clogging and has uniform openings throughout the whole surface, and a screen-formed plated article, which can be stably used as a printing screen and a cylinder for rotary printing, and is useful as an electromagnetic wave shielding material and a shadow mask. The mesh cloth is produced by using a core-sheath composite filament using a sheath comprising a component having a lower melting point than a core. A metal plating is applied on the mesh cloth, in which the core threads of the crossing threads at the point of intersection of the crossing threads are adhered to each other by melting the sheath component, the surface thereof is uniformly covered with the sheath component of the crossing threads, and the thickness of the cloth at the point of intersection is from 85 to 60% of the total thickness of the diameters of the crossing threads.

15 Claims, 3 Drawing Sheets

PRODUCTION PROCESS OF COMMERCIALLY PERFORATED NICKEL CYLINDER.

PRODUCTION PROCESS OF A CYLINDER. (EXAMPLE 8)

SCREEN-FORMED PLATED ARTICLE COMPRISING MESH CLOTH USING CORE-SHEATH COMPOSITE FILAMENT, AND CYLINDER FOR ROTARY SCREEN

This application is a 35 USC 371 national application of PCT/JP97/00860 filed Mar. 17, 1997.

TECHNICAL FIELD

The present invention relates to a screen-formed plated article comprising mesh cloth produced by using a core-sheath composite filament, which is a product suitable for a screen for printing, a cylinder for rotary printing, an electromagnetic wave shielding material, a shadow mask, and the like.

BACKGROUND ART

As a material for mesh fabrics for screen printing, silk, stainless steel, nylon, polyester and composite fibers have been conventionally used. However, because silk has problems in strength and dimensional stability, and stainless steel has problems in elastic recovery properties, these are replaced by ones made of polyester and nylon. Particularly, mesh fabric made of polyester is being frequently used from the standpoint of dimensional stability.

However, since these screens made of synthetic fibers generate static charge by friction, etc. attraction and adsorption dust may occur. The static charge may also cause ceasing of ink during printing, making precise printing impossible. Thus, a screen having been subjected to an anti-static treatment (Unexamined Published Japanese Patent Application No.6-1089) is being used, and in super precise printing, a stainless steel printing plate and a combination printing plate comprising stainless steel attached to a synthetic fiber screen plate are being used.

A metallic plate made by an electrocasting method was used instead of stainless steel for the combination plate. However, because clogging often occurs in the metallic plate made by the electrocasting method, and a large article of 1 m or larger cannot be produced, its production has been terminated.

In order to replace it, a regitide plate, in which stainless steel is spread and plating is conducted for the stainless steel plate, is used in a certain part, but it is very expensive since a large sized stainless steel plate is plated, and the production efficiency of the plate is poor.

On the other hand, as a screen mesh for textile printing, a cylindrical screen mesh (cylinder) is produced by conducting a plating method, multi-layer plating and double-side plating on a form (mother roll) to form the cylinder, as the screen textile printing of rotary type is conducted to achieve high speed textile printing. However, it is required for a long period of time to reach a certain thickness, and the production process is complicated and very expensive.

Furthermore, there are a shadow mask and an electromagnetic wave shielding material obtained by subjecting metal fabric to metal vapor deposition and coating with a black urethane, those obtained by conducting electroless vapor deposition and electrolytic plating of carbon, and those obtained by the combination of these methods. However, because the screen as a support is fabric, the point of intersection is protruded, and the cross is liable to swerve. When the thickness of the plating part is thickened to prevent swerving of the cross, the opening of the cross becomes narrow, which is not suitable for the usage of a shadow mask.

Unexamined Published Japanese Patent Application No. 4-136232 discloses mesh fabric for a screen produced by using a core-sheath composite filament using a sheath comprising a component having a lower melting point than a core, in which the point of intersection of the warp and the woof is fixed in the state that the core threads are adhered, and the surface of the warp and the woof are uniformly covered with the sheath component throughout the fabric. However, while the fabric is easy to be handled since the mesh is stably maintained, it is not considered to be formed into a screen for the screen textile printing of rotary type by weaving into a cylindrical sack form.

It is also not considered that the conventional two steps of vapor deposition of carbon and coating of black urethane can be integrated into one step by conducting black chromium plating, and the thickness of the plating can be reduced since the point of intersection is flat.

For example, it is proposed that plating is conducted on mesh fabric, but it is difficult to conduct plating without applying tension on the mesh fabric. Furthermore, since cracks are formed at the part of the point of intersection on putting up on a frame, it cannot be used for screen printing, and thus plating is conducted after putting up on a frame.

In the combination production process of a screen printing plate using an electrocasting screen mesh, the production cannot be conducted at low cost since the electrocasting mesh itself is expensive. Furthermore, since the electrocasting screen mesh is in the course of development, it is not currently available for screen printing.

Examined Published Japanese Patent Application No. 51-20630 discloses a production process of a rotary screen by weaving into a sack. However, swerving of the intersection points of the mesh occurs in a coarse mesh because the point of intersection is not fused. Because the point of intersection is not flat and the material fabric is poor in stiffness, the thickness of the plating must be increased to make the production difficult. Further, clogging occurs by scratching of the thread and feather-like dusts, and thus it cannot be subjected to practical use.

The object of the invention is to provide a screen-formed plated article comprising mesh cloth, which does not bring about clogging and has uniform openings throughout the surface, and the screen-formed plated article can be stably used as a printing screen and a cylinder for rotary printing and is also useful as an electromagnetic wave shielding material and a shadow mask.

DISCLOSURE OF THE INVENTION

In the invention, the above object is accomplished by using mesh cloth produced by using a core-sheath composite filament using a sheath comprising a component having a lower melting point than a core.

That is, the product of the invention comprises mesh cloth produced by using a core-sheath composite filament using a sheath comprising a component having a lower melting point than a core, wherein a metal plating is provided on a surface of the mesh cloth, in which core threads of threads crossing at a point of intersection of the threads are adhered to each other at the point of intersection; a surface thereof is uniformly covered by the sheath component; the cloth has a thickness at the point of intersection of from 85% to 60% of the total thickness of the crossing threads.

In the mesh cloth of the invention, since the point of intersection of crossing threads is completely fixed to prevent swerving of the intersection points, plating can be conducted without spreading on a frame. Thus, a plated plate can be easily obtained without plating with applying tension. Furthermore, owing to melting of the sheath component, the cloth has sufficient stiffness, and the thickness of the plating can be small. The feather-like dusts before melting are unified with the thread, to prevent clogging and maintain uniform openings throughout the whole surface.

Since the mesh cloth where the point of intersection is fused to be fixed has substantially no contraction and expansion property, it is substantially not stretched when it is attached to a screen plate after metal plating. Thus, metal plating can be stacked before attaching to a screen plate, and it is very easy to handle as applied to a precise printing screen.

While the mesh cloth of the invention is a plane fabric for an ordinary printing screen, it is preferably woven into a cylindrical sack. In this case, a precise cylindrical product without juncture can be obtained by putting the mesh cloth of this invention on a cylinder having a TEFLON (polytetrafluoroethylene coating and applying heat thereto. Furthermore, the cylindrical product can be effectively produced in such a manner that while the core-sheath composite filament is not woven, it is wound doubly on a cylinder with bias to make a mesh form, the point of intersection of the filament is adhered by fusion of the sheath component.

In the invention, an electromagnetic wave shielding material or a shadow mask can be obtained by applying black chromium plating on top of metal plating such as nickel plating. The mesh cloth of the invention is flat unlike the conventional screen, and exhibit no swerving of the intersection points of the mesh and substantially no contraction and expansion. Thus, it has a thin plating thickness to make black chromium plating easy, and a product optimum as an electromagnetic wave shielding material and a shadow mask.

Furthermore, in the invention, a product useful as an electromagnetic wave shielding material or a shadow mask can also be obtained by a black dyein gtreatment, such as electrolytic carbon plating or coating with black urethane, on the surface of the metal plating.

An example of a method for metal plating in the invention is as follows:

(1) Example of Electroless Nickel Plating Process (i) Hydrophilic treatment

|

(ii) Etching

|

(iii) Application of catalyst

|

(iv) Accelerator

|

(v) Chemical nickel plating

|

(vi) Electroless nickel plating (2) Electroless Nickel Plating

While electro nickel plating may be used instead of (vi) of the process (1), electroless nickel plating is generally suitable to obtain a uniform film thickness. (3) Chromium Plating and Black Chromium Plating Chromium plating or black chromium plating may be applied on top of the electroless nickel plating or the electro nickel plating.

(4) Black Dyeing Treatment

Electro copper plating is conducted instead of (iv) of the process (1), and thereafter a black dyeing treatment, such as electrolytic carbon plating or coating with black urethane, may be conducted.

As the mesh cloth of the invention, any of fabrics disclosed in Unexamined Published Japanese Patent Application No. 4-136232 may be used. Among mesh fabrics of 20 to 350 mesh, it is preferred to use a plane mesh fabric of 20 to 350 mesh for a mesh fabric for a printing screen and an electromagnetic wave shielding material, a mesh fabric woven into a cylindrical sack of 40 to 250 mesh for a cylinder for rotary printing, and a plane mesh fabric of 100 to 250 mesh for a shadow mask.

The mesh fabric comprises a composite filament having a core-sheath structure, and the filament uses a fiber component having strength as a core part and a low melting point component as a sheath part covering the core part. After weaving it into a mesh form as a plane fabric or a fabric in a cylindrical sack form, the point of intersection of the warp and the woof of the plane mesh fabric can be fixed by fusing the outer low melting point component, and for the mesh fabric in a cylindrical sack form, the fabric is put on a TEFLON-coated cylinder having an outer circumference 5 to 10% shorter than the fabric, and is shrunk by heating to fuse the outer low melting point component, so that the point of intersection of the warp and the woof is fixed.

Furthermore, the cylindrical product may be, for example, the mesh cloth on which a metal plating is provided, in which core threads of the threads crossing at a point of intersection of thread are adhered to each other by melting the sheath component, the surface of the cloth is uniformly covered with the sheath component of the crossing threads, the thickness of the cloth at the point of intersection is from 85 to 60% of the total thickness of the crossing threads, and the cross is in a bias condition with respect to the rotation direction of the cylinder. This type of products can be obtained in such a manner that the core-sheath filament is doubly wound on a cylinder with bias to a mesh form, and the point of intersection of the filament is adhered by fusing the sheath component, to form into a cylindrical form.

As the core component of the core-sheath composite filament used in the invention, a thermoplastic resin capable of forming a fiber having a high melting point and strength, such as a polypropylene, a polyester, a polyamide, etc., is preferably used. Particularly preferably used are nylon-66 as the polyamide, and a polyester obtained by the condensation reaction of an aromatic dicarboxylic acid, such as phthalic acid, naphthalene dicarboxylic acid, etc., and an aliphatic or alicyclic diol, such as ethylene glycol, etc., mixed in prescribed amounts. A polyethylene terephthalate (PET) is particularly preferably used.

As the sheath component of the core-sheath composite filament, a thermoplastic resin having a melting point lower than the resin used as the core component by 20° C. or more, preferably by 30° C. or more, including a low density polyethylene, a high density polyethylene, an ethylene-vinyl acetate copolymer, a low melting point polyester, a polyamide resin such as nylon-6, their mixtures, etc. can be used.

Among the thermoplastic resins having a low melting point used as the sheath component, it is preferred to use a polyester having a low melting point. Particularly, the use of copolymer polyester resins is preferred, which is produced by a condensation reaction of an aliphatic dicarboxylic acid, such as adipic acid, sebacic acid, etc., an aromatic dicarboxylic acid, such as phthalic acid, isophthalic acid, naphthalene carboxylic acid, etc., and/or an alicyclic dicarboxylic acid, such as hexahydroterephthalic acid, etc., with an aliphatic or alicyclic diol, such as ethylene glycol, propylene glycol, hexanediol, p-xylene glycol, etc., mixed in the prescribed amounts, and added with an oxy acid, such as p-xylene benzoic acid depending on necessity. Particularly, the use of a polyester is particularly preferred, which is obtained by addition copolymerizing isophthalic acid and 1,6-hexane diol with terephthalic acid and ethylene glycol.

These core component and the sheath component are span to have a core-sheath structure by the conventionally known composite spinning method. It is preferred to spin in such a manner that the sheath component occupies from 20 to 80% of the whole cross section of the fiber.

By making the fiber cross sectional area of the sheath component to the above proportion of area, the point of intersection of the threads of the mesh cloth is firmly fixed by the fusion of the sheath component through the post processing described later. Further, the point of intersection of the threads does not protrude when the mesh cloth is plated, to obtain a flat smooth surface, and thus cracks are not formed at the point of intersection when the tension is applied.

In the invention, the above-described core-sheath composite filament may be used as a monofilament or a multifilament. In the case of the multifilament, the core components of each of the threads are agglomerated and the sheath component covers around them by the heat treatment described later, and thus they are processed into one like a monofilament. In order to obtain a product of good printing property, the use of the monofilament is preferred, and the multifilament may be used for an electromagnetic wave shielding material and a shadow mask.

The fineness of the core-sheath composite fiber is enough as it is 1 denier or more, and it is preferably from 5 to 200 denier, and particularly preferably from 10 to 100 denier.

In the case where the mesh cloth is a plane fabric, it may be woven by the method similar to the ordinary screen mesh fabric. In the case of a fabric of a cylindrical sack form, it may be woven into a sack form by a fly loom.

For example, in the case of a mesh fabric having a low density of 100 mesh or lower, particularly 50 mesh or lower, a precise mesh can be formed by weaving into a plain fabric, and applying dry heat on weaving to adhere the point of intersection of the warp and the woof.

The weave density of the thus-woven mesh fabric is generally from 10 to 350 per inch (from 10 to 350 mesh), preferably from 20 to 300 per inch (from 20 to 300 mesh). The weave density is appropriately selected depending on the objective use, the pattern to be printed, the precision of printing and the characteristics of the product.

The mesh cloth of the invention, in the case of a plane fabric, can be produced by weaving a mesh fabric, and applying dry heat with applying tension to set and integrate the fabric, followed by cooling, as described in the foregoing. In the case of a fabric in a form of cylindrical sack, it can be formed into a cylindrical form by putting on a TEFLON-coated cylinder having an outer circumference smaller than the fabric by 5%, and immersing in a hot air high temperature incubator, to fit on the cylinder through the dry heating shrinkage of the threads, so as to form into a precise cylindrical form without juncture. In the case where the filament is wound on a cylinder to form into a mesh form, the production can be conducted by wounding the filament on the cylinder with applying tension to make a mesh form, and conducting a dry heating treatment to adhere the point of intersection of the crossing threads by fusing the sheath component of the filament, followed by cooling.

The heating temperature is a temperature between the melting point of the sheath component and the melting point of the core component of the core-sheath composite filament, and it is preferably a high temperature near the melting point of the core component. In the case where the sheath component is a low melting point polyester, it is generally heated to a temperature of from 120 to 220° C.

The mesh fabric has an appearance like a smooth resin molded article without substantially any protrusion at the point of intersection of the threads. Because the whole structure of the fabric is covered with a molten material of the sheath component of the core-sheath composite filament constituting the fabric, the resin layer can be adhered under the uniform condition with substantially no shrinkage, and thus plating can be extremely effectively conducted.

As the metal to be plated on the mesh cloth, in the case where the black chromium plating is conducted for a screen printing plate or a shadow mask, it can be formed from anyone of stainless steel, nickel, a nickel alloy, chromium, hard chromium, etc., and particularly, it is preferred to conduct nickel plating according to the known method.

The plating may be applied on one side of the mesh cloth, but it is preferred to apply on both sides from the standpoint of the objective use and the production process.

In the case where the plated product is used by spreading on a screen frame, the screen plate may be produced with wood, metals and casts of aluminum, stainless steel, steel, etc., and it is generally preferred to use a frame produced by working an extruded material of aluminum from the standpoint of strength, light weight, corrosion, etc. In the case where it is used for printing requiring fine precision, the use of a frame made of a cast is preferred from the standpoint of the dimensional precision.

The mesh product with the black chromium plating is attached to a frame, etc., and subjected to resin coating or plastics lamination, so as to be used as a shadow mask or an electromagnetic wave shielding material.

In the general production process of a shadow mask, it has been produced by forming a metal thin film on a mesh fabric by electroless plating, vapor deposition or sputtering, and thereafter electrolytically plating carbon or coating black urethane. In the case of coarse mesh of 60 mesh (60 per inch) or less, swerve of the cross has occurred, and even if the swerve of the cross is prevented by conducting resin coating with applying tension, swerve of the cross on the resin coating becomes a problem, so that a practical product could not be obtained. However, in the product of the invention, because the mesh cloth, in which the point of intersection of the warp and the woof is fixed by the fusion, is used as the base, and black chromium plating is formed on the surface thereof, the interval of the mesh is hard to be deformed and is excellent in dimensional stability, and therefore a product of coarse mesh can be consistently produced in a very short period of time with good workability.

The production process of a cylinder of rotary screen printing includes an electrocasting method, a plating method, a multi-layer plating method, a double sided plating method, etc., and the perforated nickel cylinder and the pierce etching method developed by N.V. VECKO and STORK in Netherlands utilizing nickel etching of a nickel cylinder have be practically used. The perforated nickel cylinder is produced by such a manner that a mesh master die is produced and hardened by quenching, a mill is produced, followed by hardening, it is indented on a copper-plated mandrel to form a mother roll, a non-electroconductive material such as an epoxy resin is filled in the opening of the mesh (opening interval) of the mother roll, followed by polishing, nickel plating having a prescribed thickness is formed at the bridge part, to form a perforated nickel cylinder, and then the nickel cylinder is withdrawn from the mother roll. In the pierce etching method, nickel plating is applied on a stainless steel mother roll, a photosensitive agent is coated, an image is printed, followed by development, only the part of the pattern is etched, and the etched nickel cylinder is withdrawn from the stainless steel mother roll.

In these conventional methods, the opening of the mother roll is narrow, and thus the production required a long period of time and becomes very expensive, so as to be difficult to produce a practical high mesh product.

On the other hand, in the case where the mesh cloth of the invention is formed into a fabric in the cylindrical sack form, or in the case where it is produced in a cylindrical form by winding the filament on a cylinder, because the mesh cloth of a cylindrical form, in which the point of intersection of the crossing threads is fixed by fusion, is used, and the surface thereof is plated, the opening (opening interval) is wide, and the base is stiff and thick, so that the amount of the plated layer may be small. Thus, a product of fine mesh can be consistently produced in a short period of time with good workability.

BEST MODE FOR PRACTICING THE INVENTION

Figure 1:
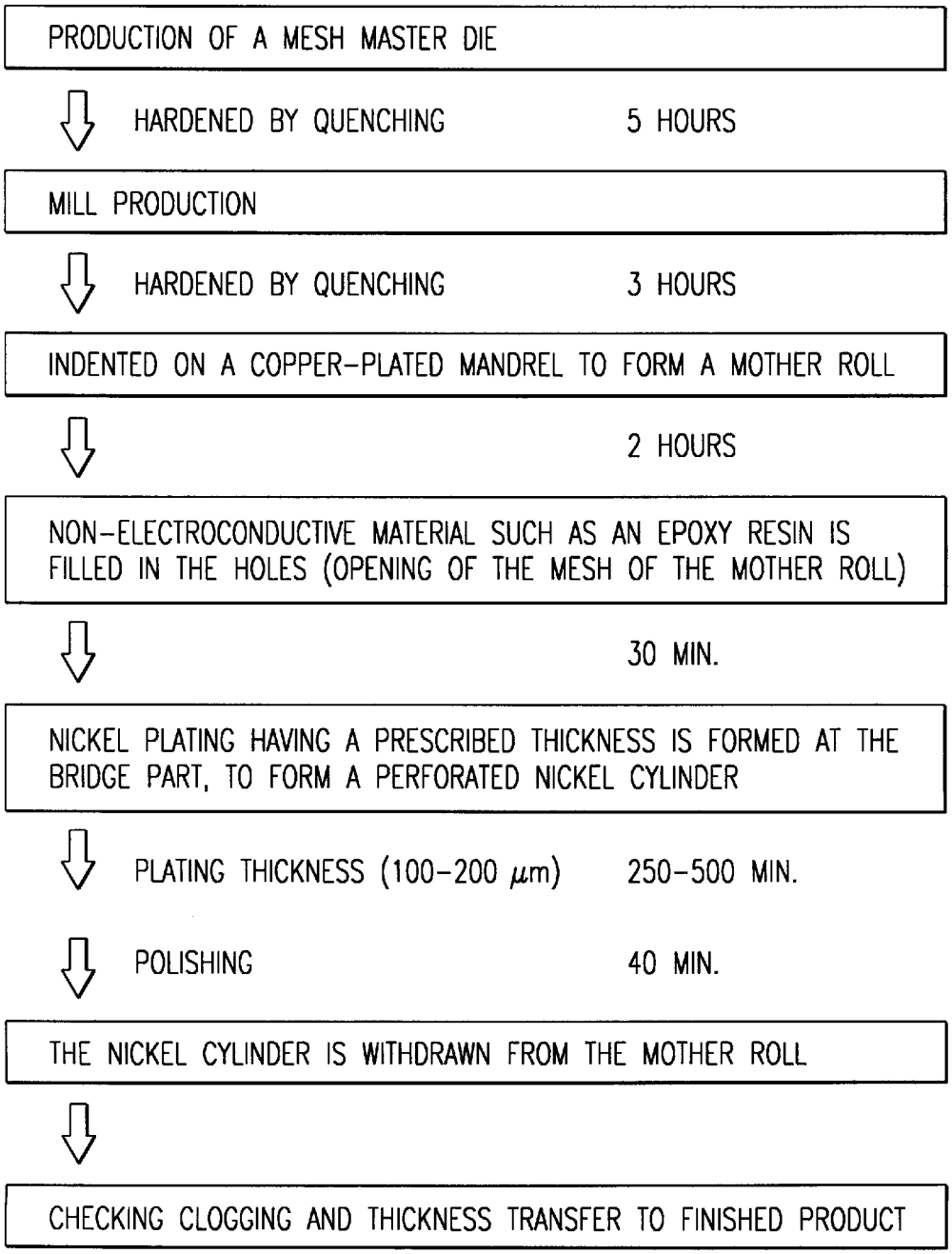
FIG. 1 PRIOR ART
FIG. 1 is a flow diagram showing the production process of a commercially available cylinder for a rotary screen (perforated nickel cylinder).

The invention is described in more detail with reference to the examples.

(1) Examples of Production of Cloth Used in the Invention

Example (1)

Plane Mesh Fabric

Plane mesh fabrics of 50 mesh, 130 mesh and 300 mesh were produced by using a core-sheath composite filament composed of a core comprising a copolymer polyethylene terephthalate having a melting point of 265° C. and a sheath comprising a copolymer polyester having a melting point of 150° C. (terephthalic acid/isophthalic acid=75/25).

The plane mesh fabrics of 50 mesh and 130 mesh were, after weaving, passed in a heating apparatus with applying tension by a winding apparatus, to fuse the sheath part of the filament and to adhere the point of intersection of the warp and the woof, followed by cooling and winding. The plane mesh fabric of 300 mesh was, after weaving, adjusted to the prescribed density with applying tension by a tenter, and set by dry heating to adhere the point of intersection of the warp and the woof, followed by cooling by a cooling apparatus and winding.

The characteristics of the thus-produced three kinds of mesh fabrics are shown in Table 1 as compared with a commercially available polyester-made mesh fabric for screen printing.

Products of Example 1

(1) 50 mesh fabric of 55$\mu$ composite fiber (2) 130 mesh fabric of 48$\mu$ composite fiber (3) 300 mesh fabric of 35$\mu$ composite fiber Commercially Available Products (produced by Nippon Tokushu Fabric Co., Ltd.)

(1) 50 mesh fabric of 55$\mu$ polyester fiber (2) 130 mesh fabric of 48$\mu$ polyester fiber (2) 300 mesh fabric of 35$\mu$ polyester fiber

Example (2)

Mesh Fabric of Cylindrical Sack Form

Mesh fabrics of a cylindrical sack form of 80 mesh, 200 mesh and 250 mesh were produced by using the same filament as in Example 1.

The mesh fabrics of a cylindrical sack form of 80 mesh and 200 mesh were woven into a sack formed sack structure having an outer circumference of 666 mm, cut into a prescribed length of 2,000 mm, put on a TEFLON-coated cylinder (diameter: 202 mm, cylinder length: 2,010 mm), and allowed to stand in a hot air high temperature incubator at 190° C. for 3 minutes to fit on the cylinder by the shrinkage of the filament and to adhere the point of intersection of the warp and the woof, so as to made into a cylindrical form, followed by cooling at room temperature.

For comparison, the same production was conducted by using a polyester monofilament. However, hardness and stiffness could not be obtained even putting in the high temperature incubator, but a simple sack is only obtained. That is, the fabric of a sack form of 80 mesh could not be a product since it was totally deformed. The fabrics of a sack form of 200 mesh and 250 mesh could not become a cylindrical form although the cross was not swerved, which could not be subjected to the subsequent plating step. The state of the products obtained in Example 2 and the comparative example is shown in Table 2.

TABLE 1

| Kind of fabric | Swerve of cross | Stretching | Point of intersection | | Stiffness |
|---|---|---|---|---|---|
| Product of Example 1 | | | | | |
| 50 mesh | no | hard to stretch | fused | no protrusion | hard and stiff |
| 130 mesh | " | " | " | " | " |
| 300 mesh | " | " | " | " | " |
| Commercially available product | | | | | |
| 50 mesh | present | stretch | liable to swerve | protrusion | soft |
| 130 mesh | liable to occur | " | swerve | " | " |
| 300 mesh | no | " | hard to swerve | " | " |

TABLE 2

| Kind of fabric | Swerve of cross | Point of intersection | | State of cylinder |
|---|---|---|---|---|
| Product of Example 2 | | | | |
| 80 mesh | no | fused | no protrusion | became cylinder |
| 200 mesh | " | " | " | " |
| 250 mesh | " | " | " | " |
| Commercially available product | | | | |
| 80 mesh | present | liable to swerve | protrusion | not became cylinder |
| 200 mesh | no | not swerve | " | " |
| 250 mesh | " | " | small protrusion | " |

As clear from Table 2, in the composite fiber mesh fabric of a cylindrical sack form used in the invention, swerve of the cross did not occur to form the precise opening, and it became a precise cylinder like a resin molded article, which could be stably applied to the subsequent plating step.

Example (3)

Cloth Formed by Winding Filament on Cylinder

In the structure, in which the core-sheath composite filament was wound on a cylindrical drum through a thread supplying nozzle, the thread supplying nozzle ran in the axial direction of the drum, which rotated, and the thread was doubly wounded in a bias condition.

Sheets of a mesh form of 50 mesh, 200 mesh and 300 mesh were formed as above, and were heated with applying tension to the filament by a winding apparatus, to fuse the sheath part of the filament and to adhere the point of intersection of the threads, followed by cooling, so that mesh cloth formed into a cylinder form without juncture.

For comparison, an ordinary polyester thread was wound on the drum with applying a resin in the similar manner as in Example 3, followed by heat set. The characteristics of these products and the products obtained in Example 3 are shown in Table 3.

Products of Example 3

(1) 50 mesh fabric of 100$\mu$ composite fiber (2) 200 mesh fabric of 55$\mu$ composite fiber (3) 300 mesh fabric of 40$\mu$ composite fiber Products of Comparative Example (1) 50 mesh resin treated formed article of 100$\mu$ polyester (2) 200 mesh resin treated formed article of 55$\mu$ polyester (3) 300 mesh resin treated formed article of 40$\mu$ polyester As clear from Table 3, in the mesh formed article of the invention, swerve of the cross did not occur, the point of intersection was flat without protrusion, the surface was smooth, and it was hard to stretch. Furthermore, it formed precise opening, and clogging did not occur.

On the other hand, in the formed article of the ordinary polyester, clogging occurred in the fine mesh (300 mesh), and swerve of the cross occurred due to the weak adhesion of the point of intersection in the coarse mesh (50 mesh). In the article of 200 mesh, the cross was not precise due to the resin, protrusions of the upper layer and the lower layer occurred, it was poor in stiffness, and as a result, it was not suitable for a mother material for metal plating.

(2) Examples of Production of Plated Products

The mesh cloth obtained in Examples (1) to (3) was plated, and these were compared with those obtained by plating commercially available 50 mesh, 130 mesh and 300 mesh fabrics, and the plated product obtained by plating commercially available 300 mesh fabric.

Example (4)

The electroless nickel plating was applied to the plain mesh fabrics obtained in Example (1) and the commercially available mesh fabrics compared in Example (1) by the above-described method. The state of the product obtained is shown in Table 4.

TABLE 3

| | Treatment | Mesh | Suitability as cylinder mother material |
|---|---|---|---|
| Example 3 | Fusion of sheath component of composite fiber | 100$\mu$ 50 mesh | Suitable as cylinder mother material |
| | | 55$\mu$ 200 mesh | " |
| | | 40$\mu$ 300 mesh | " |
| Comparative Example | Polyester fiber treated with resin | 100$\mu$ 50 mesh | Could not be used since point of intersection came off |
| | | 55$\mu$ 200 mesh | Could not be used due to distortion of pores and poor stiffness |
| | | 40$\mu$ 300 mesh | Could not be used due to clogging |

TABLE 4

| Plated fabric | Swerve of cross | Stretching | Point of intersection | State of plating on applying tension |
|---|---|---|---|---|
| Product of Example 1 | | | | |
| 50 mesh | no | hard to stretch | no protrusion | hard and stiff |
| 130 mesh | " | " | " | " |
| 300 mesh | " | " | " | " |
| Commercially available product | | | | |
| 50 mesh | large | — | — — | — |
| 130 mesh | no | stretch | swerve protrusion | hard and stiff |
| 300 mesh | " | " | hard to swerve " | " |

As clear from Table 4, in the fabrics of Example (1) of the invention, plated products could be stably obtained since swerve of the cross did not occur in the coarse mesh. Furthermore, since the composite fiber mesh fabrics became a flat plate-like form, plating with good quality with no wrinkle could be formed without applying tension, and plating could be easily conducted by using the conventional plating bath.

However, when the commercially available products were plated in the same manner, a practical plated product was difficult to be obtained due to the generation of wrinkle and sag. Then, plating was conducted with maintaining the tension for the commercially available products, and the results are shown in Table 4.

The method for applying tension includes a method, in which when a fabric is wound from a roll to another roll, tension is applied by differentiating the winding speeds of the rolls, a method, in which a fabric is spread on a frame and plated along with the frame, and a method, in which a fabric is hung with applying a load and plated. In this example, the method was conducted, in which the fabric was hung with applying a load and plated.

Example (5)

Test for Practical Use of Plated Fabric

Tests for strength and stretching were conducted for the composite fiber plated mesh fabrics of the invention obtained in Example (4), plated fabrics obtained by plating the commercially available mesh fabrics with applying a load, and commercially available plated mesh fabrics (Metalen 137 mesh, 305 mesh (120 mesh or lower was not available due to swerve of the cross) produced by Z.B.F. Switzerland), and the state of the surface under load was compared. The results are shown in Table 5.

Test method:

JIS L1096 Label stripping method

Testing apparatus:

Constant speed tension tester (produced by Shimadzu Corp.)

Test conditions:

test width: 5 cm chuck distance: 20 cm tensile speed: 20 cm/min

TABLE 5

| Kind of plated fabrics | State | Evaluation |
|---|---|---|
| Product of Example 4 | | |
| 50 mesh | At load of 18 kgf, point of intersection not come off and surface not changed | suitable for practical use |
| 130 mesh | At load of 20 kgf, point of intersection not come off and surface not changed | suitable for practical use |
| 300 mesh | At load of 20 kgf, point of intersection not come off and surface not changed | suitable for practical use |
| Plated commercially available polyester mesh | | |
| 50 mesh | Could not become product due to swerve of cross | not suitable for practical use |
| 130 mesh | At load of 5 kgf, point of intersection came off, and at load of 1.5 kgf, cracks formed | not suitable for practical use |
| 300 mesh | At load of 5 kgf, point of intersection came off, and at load of 10 kgf, cracks formed | not suitable for precise printing |
| Commercially available plated mesh | | |
| 137 mesh | At load of 5 kgf, point of intersection came off, and at load of 15 kgf, cracks formed | not suitable for practical use |
| 300 mesh | At load of 5 kgf, point of intersection came off, and at load of 10 kgf, cracks formed | not suitable for precise printing |

As clear from Table 5, in the commercially available plated products, a protrusion was present at the point of intersection of the threads, and cracks were formed in the plating on applying tension due to stretching of the fabric as a core of the plating. As a result, they were not suitable for printing use.

On the other hand, in the fabrics comprising the composite fiber of the invention, the point of intersection of the warp and the woof was firmly fixed by fusion of the sheath component, no protrusion was formed at the point of intersection, and the surface thereof was smooth. Thus, no crack was formed on applying tension, and they were stably used in the plate-making step and the printing step described later.

Example (6)

Black Chromium Plating

The plating in Example (4) was changed to electro nickel plating, and black chromium plating was applied thereon. These plating processes were those described above.

The resulting products were compared with commercially available shadow mask and electromagnetic wave shielding material for production process and state of the products. The results obtained are shown in Table 6.

| | Process | State of product |
|---|---|---|
| Composite fiber fused fabric of the invention with black plating | Only black chromium plating is applied. | Because the point of intersection is fixed and the surface is flat, the thickness of the plating may be small. The opening is also wide. |
| Product of conventional production process | A product with swerve of the cross must be subjected resin treatment for filling up, electroless plating, and then vapor deposition of carbon, and further it must be subjected resin treatment such as a urethane resin. | Because the point of intersection is protruded and the surface is not smooth, clogging occurs in the resin treated product. Because the thickness of the plating is large, the opening is narrow. |

As clear from Table 6, in the mesh fabric of the invention, since swerve of the cross did not occur, black chromium plating could be directly applied in a stable manner. In the coarse mesh, the step of resin treatment was not required, and the vapor deposition of carbon and the black urethane coating in the conventional process could be integrated into one step. Furthermore, since the point of intersection of the warp and the woof was flat, the thickness of the plating could be small, and a product with good quality could be obtained at low cost in a short period of time with extremely good workability.

Example (7)

Test for Plate-making

In order to confirm the suitability as a screen for precise printing, the plated product of the invention (product of 300 mesh) produced in Example (5) was transferred to a gauze-spreading step, and spread on a frame by a gauze-spreading apparatus.

The conditions for the frame spreading are as follows:

Gauze-spreading apparatus: Air stretcher

Aluminum frame: Commercially available product 880×880 mm (width: 40 mm, thickness: 25 mm)

Tension: 1.00 mm

For comparison, the mesh fabric (non-plated product) produced in Example (1), a commercially available polyester screen plated mesh fabric, Metalen 305 mesh produced by Z.B.F. Switzerland, and New Superstrong 300 mesh produced by Nippon Tokushu Fabric Co., Ltd. were spread on a frame.

The results of plate-making test for them are shown in Table 7.

TABLE 7

| Tension (mm) | Product of Example 4 (plated product) 300 mesh | Product of Example 1 (non-plated product) 300 mesh | Commercially available polyester mesh 300 mesh | Commercially available polyester plated mesh 305 mesh |
|---|---|---|---|---|
| 1.50 | 0.4% | 1.2% | 4.2% | 2.5% |
| 1.40 | 0.6% | 1.6% | 5.5% | crack at point of intersection |
| 1.30 | 0.8% | 2.2% | 6.3% | |
| 1.20 | 1.0% | 3.0% | 7.0% | 7.5% |
| 1.10 | 1.2% | 3.5% | 7.0% | fracture |
| 1.00 | 1.6% | 4.5% | 8.3% | |
| 0.90 | 1.8% | 5.8% | 10.5% | |
| 0.80 | 2.0% | 6.5% | 12.5% | |
| 0.70 | 2.2% | 7.0% | fracture | |
| 0.60 | 2.4% | fracture | | |

As clear from Table 7, in the product of the invention (plated product in Example 4), high tension could be obtained with slight stretching. In the composite fiber fused mesh (mesh fabric in Example 1), since the stretching is small as compared to the mesh made of ordinary polyester (commercially available polyester mesh), and the point of intersection did not come off until fracture, it could be understood that it was optimum as a mother material of the product of the invention.

On the other hand, in the commercially available plated mesh fabric products, since the fabric as a core of the plating was stretched at high tension, cracks were formed on the plating, and it is not suitable for the use of high tension precision printing.

Example (8)

Cylinder for Rotary Screen

The mesh fabric of a cylindrical sack form obtained in Example (2) was plated by the known plating method, and compared with a commercially available cylindrical mesh for rotary screen for the characteristics and the production process of the products. (See Table 8 and FIGS. 1 and 2.)

TABLE 8

| | Mesh and opening ratio of lacquer plate of commercially available cylinder and cylinder of the invention | | | |
|---|---|---|---|---|
| | | Mesh | Thickness (standard) μm | Opening ratio % |
| Products invention | Example 8 | 80 | 92 | 66 |
| | | 200 | 79 | 35 |
| | | 250 | 60 | 31 |
| | Example 9 | 80 | 92 | 64 |
| | | 200 | 79 | 32 |
| | | 250 | 60 | 27 |
| Commercially available products | Regular Screen | 20 | 160 | 43 |
| | | 40 | 100 | 36 |
| | | 60 | 95 | 21 |
| | | 80 | 90 | 13 |
| | | 100 | 90 | 11 |
| | Dia Screen | 120 | 90 | 12 |
| | EX Screen | 40 | 110 | 45 |
| | | 60 | 100 | 35 |
| | | 80 | 100 | 25 |
| | | 100 | 100 | 23 |
| | Penta Screen | 125 | 95 | 15 |
| | | 155 | 95 | 13 |
| | | 185 | 95 | 11 |
| | | 215 | 90 | 7 |

As clear from Table 8, in the plated product of the mesh fabric of a cylindrical sack form of the invention, since the bridge part was precisely formed with the composite fiber, and the point of intersection was fused, the thickness of the plating was small, the opening was wide, and the opening ratio (%) was extremely large, as compared with the commercially available nickel plated cylinder.

On the other hand, in the nickel cylinder, the thickness was required to have a certain value (60 to 200 μ) from the standpoint of strength, and the width of the bridge part was required to be 60 μ or more. Thus, the production of high mesh was difficult, the opening was narrow, and the opening ratio (%) was small.

Figure 2:
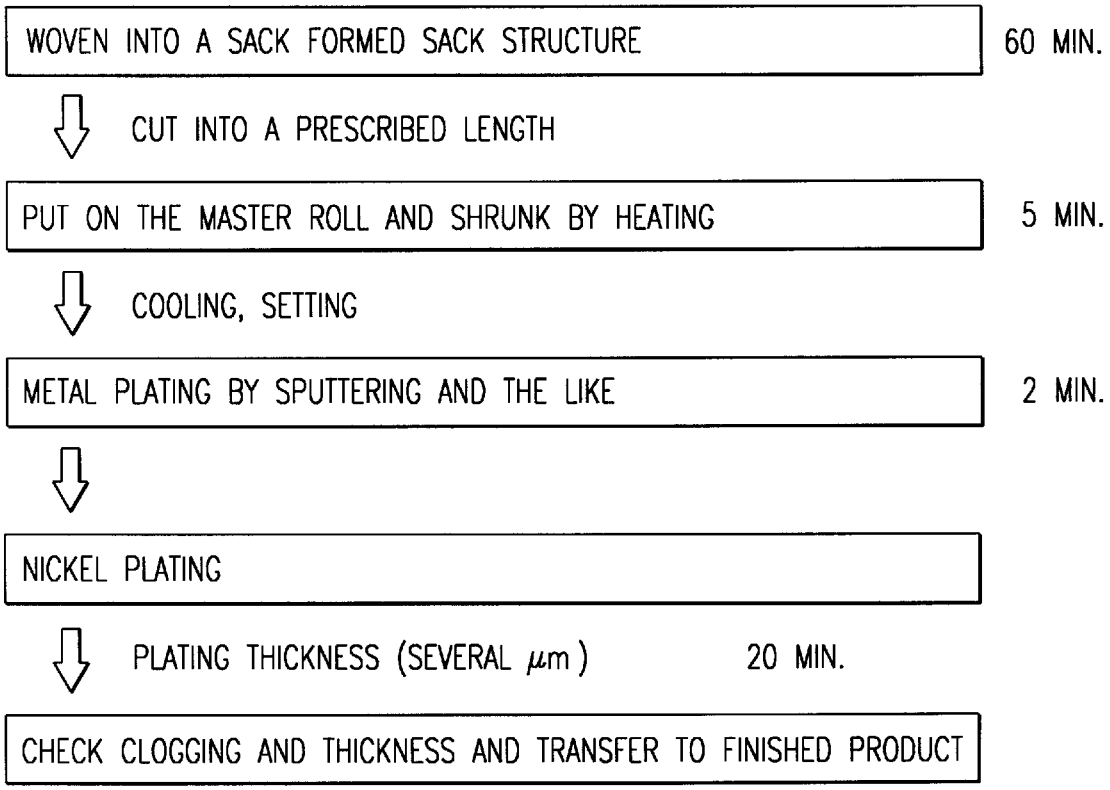
FIG. 2 is a flow diagram showing the production process of a cylinder for a rotary screen in one example of the invention.

The commercially available nickel cylinder is produced by the complicated process shown in FIG. 1, but the plated product of the mesh fabric of a cylindrical sack form of the invention can be produced by the extremely simple process shown in FIG. 2 in a stable manner, in a short period of time, in good efficiency, with precision, to produce a cylinder having practical utility. Furthermore, the thickness of the plating is enough as a few microns, and thus the production cost can be reduced.

It can be considered that a plated product of the plane fabric produced in Example (4) is made into a cylinder, but since a juncture is formed and the production steps are increased, it is the optimum way to weave into a cylindrical sack form.

In the plated product of the mesh fabric of a cylindrical sack form of the invention, the production of high mesh is possible under the thread diameter of the composite fiber and the weaving conditions if it is woven into a cylindrical sack form, and the precision and patterns of the subsequent printing step and the printed material become fine.

In the plated product of the mesh fabric of a cylindrical sack form of the invention, an ink, a pigment and a dye can be well pass due to the large opening ratio, and because the mesh is fine, a fine straight line pattern and fine dots, which cannot be printed by rotary screen printing, can be printed, and fine patterns in the flat printing can be printed without juncture and stepping of pattern.

The plated product using the mesh fabric of a cylindrical sack form of the invention sufficiently satisfies the demand of a screen mesh of high mesh having a large opening ratio without clogging (feather-like dust) and juncture, as a problem in the rotary printing industry.

Example (9)

Cylinder for Rotary Screen

Nickel plating was applied to the mesh cloth formed into a cylindrical form in Example (3), and the resulting product was then compared with a commercially available cylindrical rotary cylinder for characteristics.

Figure 3:
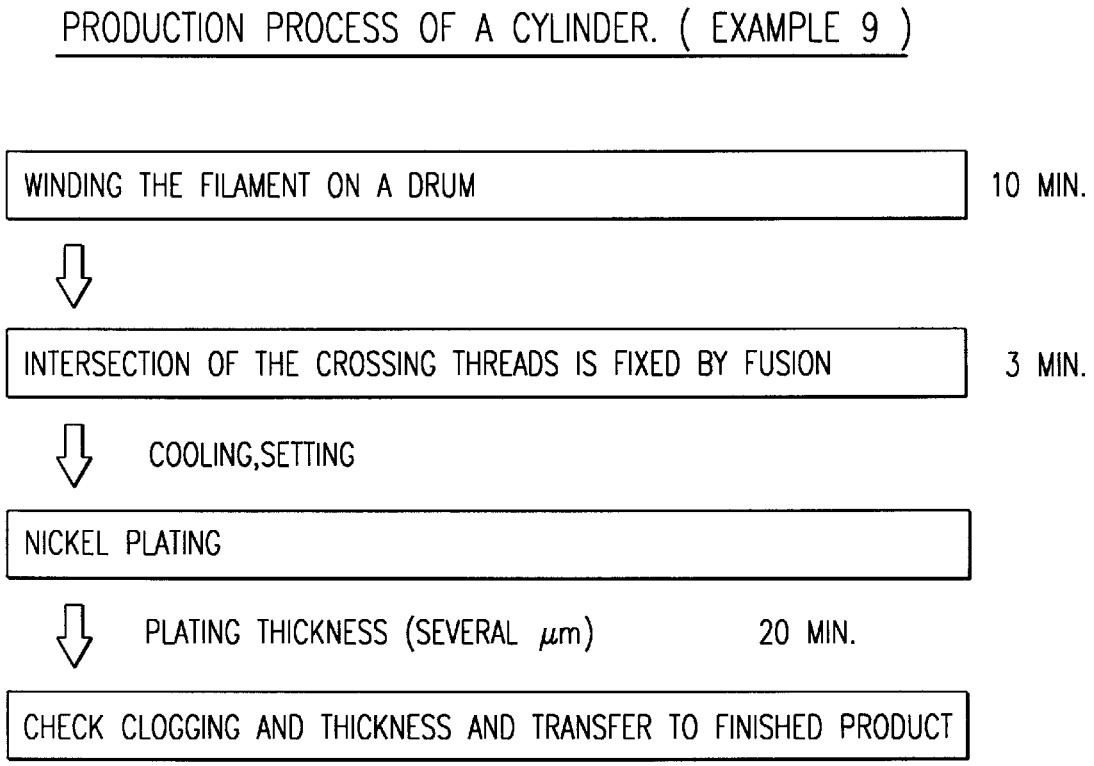
FIG. 3 is a flow diagram showing the production process of a cylinder for a rotary screen in another example of the invention.

The characteristics and the production processes are shown in Table 8 and FIG. 3.

As clear from Table 8, in the cylindrical mesh product obtained in this example, as similar to the product of Example (8), since the bridge part was precisely formed with the composite fiber, and the point of intersection was fused, the thickness of the plating was small, the opening was wide, and the opening ratio (%) was extremely large, in comparison to the commercially available nickel plated cylinder.

As clear from FIG. 3, in the process of the invention, a rotary cylinder with good quality can be produced by a very simple process in an effective and stable manner. Furthermore, since the thickness of the plating may be only a few microns, this method is very advantageous form the economical standpoint. Furthermore, in the product, since the cross is in a bias direction with respect to the squeegee direction, moire is prevented, and a very clear image can be printed.

INDUSTRIAL APPLICABILITY

The product of the invention is a fabric, in which a core-sheath composite filament comprising a sheath component having a lower melting point than a core is used in a plain mesh fabric, the warp and the woof are fixed at the point of intersection in a state where core threads are adhered to each other by fusion of the sheath component after weaving, and the sheath component uniformly covers the surface of the warp and the woof throughout the fabric. In the fabric, because the point of intersection is completely fused to prevent swerve of the cross, it can be plated without spreading on a frame, and a plated plate can be easily produced without plating with applying tension. In the screen printing using the product, precise printing is possible for not only general printing but also printing of a printed plate such as a printed circuit, a multi-layer plate, an IC circuit, etc.

By conducting black chromium plating, the vapor deposition of carbon and the black urethane coating in the conventional process can be integrated into one step, and since the point of intersection is flat, the thickness of the plating may be small, a good quality can be obtained at low cost, and considerable improvement is observed in reduction in processing time and workability.

In the plated cylinder of the mesh fabric of a cylindrical sack form of the invention, there is no juncture, the warp and the woof are firmly fixed at the point of intersection in a state where core threads are adhered to each other by fusion of the sheath component, the sheath component uniformly covers the surface of the warp and the woof throughout the fabric, and the point of intersection of the warp and the woof is integrated with the warp and the woof. Thus, it becomes a thin (85 to 60% of twice the diameter of thread) mesh fabric with less swerve of the cross, in which since the amount of the plated layer is small, the opening is large, and it is easy to thin the diameter of the thread of the composite fiber to make the mesh fine. Thus, the production of high mesh can be produced in a very short period of time, and a fine pattern that cannot be printed by the conventional rotary printing can be printed.

As described foregoing, the usefulness of the invention is clear.

What is claimed is:

1. A metal plated mesh article comprising:

a mesh formed by core-sheath composite filaments having a core component and a sheath component, the sheath component having a lower melting point than the core component;

a smooth surface uniformly covered by the sheath component formed by heat fusion of the filaments to each other at intersection points of the mesh; and a metal layer formed on the smooth surface of the mesh, wherein the mesh has a thickness at the intersection points of from 85% to 60% of a total thickness of the intersecting filaments prior to heat fusion.

2. A plated article as described in claim 1, which is useful as a cylinder for rotary textile printing, characterized in that said mesh cloth is woven into a cylindrical sack form.

3. A plated article as described in claim 1, which is useful as a mesh for screen printing, characterized in that said mesh cloth is a plane fabric.

4. The metal plated mesh article of claim 1, wherein the mesh forms a cylinder, the article being useful as a cylinder for a rotary screen.

5. A metal plated mesh article as described in claim 1, which is useful as an electromagnetic wave shielding material or a shadow mask, further comprising a black layer formed on top of the metal layer.

6. The metal plated mesh article as described in claim 5, wherein the black layer is a carbon plating.

7. The metal plated mesh article as described in claim 5, wherein the black layer is a black urethane coating.

8. The metal plated mesh article as described in claim 5, wherein the black layer is a black chromium plating.

9. A metal plated mesh article useful as an electromagnetic wave shielding or a shadow mask comprising:

a mesh having a smooth surface, wherein the mesh is formed by core-sheath composite filaments having a core component and a sheath component, the sheath component having a lower melting point than the core component, wherein the filaments are adhered to each other at intersection points of the mesh and sheath components of the filaments are fused together to form the smooth surface of the mesh;

a metal layer formed on the smooth surface of the mesh; and a black layer formed on top of the metal layer.

10. The metal plated mesh article as described in claim 9, wherein the black layer is a carbon plating.

11. The metal plated mesh article as described in claim 9, wherein the black layer is a black urethane coating.

12. The metal plated mesh article as described in claim 9, wherein the black layer is a black chromium plating.

13. A method for producing a cylinder for a rotary screening, comprising:

weaving a sack mesh structure from core-sheath composite filaments having a core component and a sheath component with a lower melting point than the core component, the sack mesh structure having an inner circumference;

placing the sack mesh structure on a master roll having an outer circumference smaller than the inner circumference of the sack mesh structure;

heating the sack mesh structure to shrink it and to fuse the sheath components of the filaments together so that the filaments adhere to each other at intersection points of the mesh to form a cylinder having inner and outer smooth surfaces; and plating at least one of the smooth surfaces of the cylinder with a metal.

14. The method of claim 13, wherein the inner circumference of the sack mesh structure is larger by 5% than the outer circumference of the master roll.

15. A method for producing a cylinder for a rotary screening, comprising:

winding core-sheath composite filaments on a drum, the core-sheath composite filaments having a core component and a sheath component with a lower melting point than the core component, wherein the core-sheath composite filaments cross each other at intersection points to form a mesh;

heating the wound filaments to fuse the sheath components of the crossing filaments together so that the filaments adhere to each other at the intersection points of the mesh to form a cylinder having inner and outer smooth surfaces; and plating at least one of the smooth surfaces of the cylinder with a metal.

* * * * *